US011624593B2

(12) United States Patent
Ozanne et al.

(10) Patent No.: US 11,624,593 B2
(45) Date of Patent: Apr. 11, 2023

(54) VENTED ARROW

(71) Applicant: MCP IP, LLC, Sparta, WI (US)

(72) Inventors: Jeffrey A. Ozanne, La Crosse, WI (US); Jeffrey J. Ozanne, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 17/511,418

(22) Filed: Oct. 26, 2021

(65) Prior Publication Data

US 2022/0049939 A1 Feb. 17, 2022

Related U.S. Application Data

(63) Continuation of application No. 16/747,413, filed on Jan. 20, 2020, now Pat. No. 11,156,440.

(60) Provisional application No. 62/794,423, filed on Jan. 18, 2019.

(51) Int. Cl.

| | |
|---|---|
| ***F42B 6/04*** | (2006.01) |
| ***F42B 6/06*** | (2006.01) |
| ***F42B 12/36*** | (2006.01) |

(52) U.S. Cl.

CPC ..... *F42B 6/06* (2013.01); *F42B 6/04* (2013.01); *F42B 12/362* (2013.01)

(58) Field of Classification Search

CPC ..... F42B 6/04; F42B 6/06; F42B 6/08; F42B 12/362

See application file for complete search history.

(56) References Cited

U.S. PATENT DOCUMENTS

| | | | |
|---|---|---|---|
| 3,393,912 | A | 7/1968 | DeLonais |
| 3,617,060 | A | 11/1971 | Iezzi |
| 3,995,860 | A | 12/1976 | Manspeaker |
| 4,210,330 | A | 7/1980 | Kosbab |
| 4,398,354 | A | 8/1983 | Finlay |
| 4,410,184 | A | 10/1983 | Anderson |
| 4,656,994 | A | 4/1987 | Jenks |
| 4,706,965 | A | 11/1987 | Schaar |
| 4,866,810 | A | 9/1989 | Kudlacek |
| 5,067,731 | A | 11/1991 | Bickel |
| 5,273,293 | A | 12/1993 | Lekavich |
| 5,290,044 | A | 3/1994 | Easton et al. |
| 5,361,747 | A | 11/1994 | Laabs |
| 5,417,439 | A | 5/1995 | Bickel |
| 5,516,117 | A | 5/1996 | Rangel |
| 5,919,105 | A | 7/1999 | Summers |
| 5,921,875 | A | 7/1999 | Bickel |
| 6,142,895 | A | 11/2000 | Jason |
| 6,203,457 | B1 | 3/2001 | Snook |
| 6,390,642 | B1 | 5/2002 | Simonton |
| 6,428,433 | B1 | 8/2002 | Liechty, II |
| 7,485,056 | B2 | 2/2009 | Sullivan et al. |
| 8,057,330 | B2 | 11/2011 | Blosser et al. |
| 8,251,845 | B2 | 8/2012 | Bay |
| 8,257,208 | B2 | 9/2012 | Harding |
| 8,267,815 | B2 | 9/2012 | Braun et al. |
| 8,337,342 | B1 | 12/2012 | Huang |
| 8,342,990 | B1 | 1/2013 | Price |

(Continued)

*Primary Examiner* — John A Ricci

(74) *Attorney, Agent, or Firm* — Laabs Intellectual Property

(57) ABSTRACT

In some embodiments, an arrow comprises a shaft comprising a tubular wall comprising a cavity and a nock comprising a notch arranged to engage a bowstring. An intake inlet is in fluid communication with the cavity and an exhaust outlet is in fluid communication with the cavity.

20 Claims, 26 Drawing Sheets

(56) References Cited

U.S. PATENT DOCUMENTS

| | | | |
|---|---|---|---|
| 8,403,777 | B1 | 3/2013 | Huang |
| 8,920,268 | B2 | 12/2014 | Boretto |
| 9,068,804 | B2 | 6/2015 | McPherson |
| 9,383,177 | B1 | 7/2016 | Kallmes |
| 9,933,238 | B1 | 4/2018 | Campbell |
| 10,480,913 | B1 | 11/2019 | Schabel et al. |
| 11,156,440 | B2 | 10/2021 | Ozanne et al. |
| 2003/0083159 | A1 | 5/2003 | Kane |
| 2007/0225093 | A1 | 9/2007 | Kidwell |

VENTED ARROW

CROSS-REFERENCE TO RELATED APPLICATIONS

This application claims the benefit and is a continuation of U.S. patent application Ser. No. 16/747,413, filed Jan. 20, 2020, which claims the benefit of U.S. Patent Application No. 62/794,423, filed Jan. 18, 2019, the entire contents of which are hereby incorporated herein by reference.

BACKGROUND OF THE INVENTION

This invention relates to archery projectiles such as arrows. Archery bows and arrows are generally known. When using a bow, the energy used to launch an arrow generally comes from the user. The user will draw the bow, typically flexing limbs and storing energy in the bow. When the bow is released, the stored energy is used to propel the arrow.

Arrows are often spin-stabilized, for example using fletching vanes that are angled slightly with respect to the arrow shaft. A greater offset angle in the fletching will produce a greater amount of arrow rotation, which can provide better stabilization for the arrow but also increases drag. Thus, there is a trade-off between spin-stabilized accuracy and the energy level in the arrow when it hits a target. An arrow configured for long range energy may have reduced accuracy at distance, while an arrow configured for spin-stabilized accuracy may not have a desirable energy level at distance.

There remains a need for novel arrow configurations that reduce drag and increase accuracy when compared to known designs.

All US patents and applications and all other published documents mentioned anywhere in this application are incorporated herein by reference in their entirety.

BRIEF SUMMARY OF THE INVENTION

In some embodiments, an arrow comprises a shaft comprising a tubular wall comprising a cavity and a nock comprising a notch arranged to engage a bowstring. An intake inlet is in fluid communication with the cavity and an exhaust outlet is in fluid communication with the cavity.

In some embodiments, the nock comprises an exhaust outlet. In some embodiments, the shaft comprises an exhaust outlet.

In some embodiments, the nock comprises the intake inlet.

In some embodiments, the arrow comprises a tip and the tip comprises the intake inlet.

In some embodiments, an inlet comprises a NACA duct arrangement.

In some embodiments, an arrow comprises a shaft comprising a tubular wall comprising a cavity, wherein the tubular wall comprises a plurality of apertures in fluid communication with the cavity. An intake is in fluid communication with the cavity.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
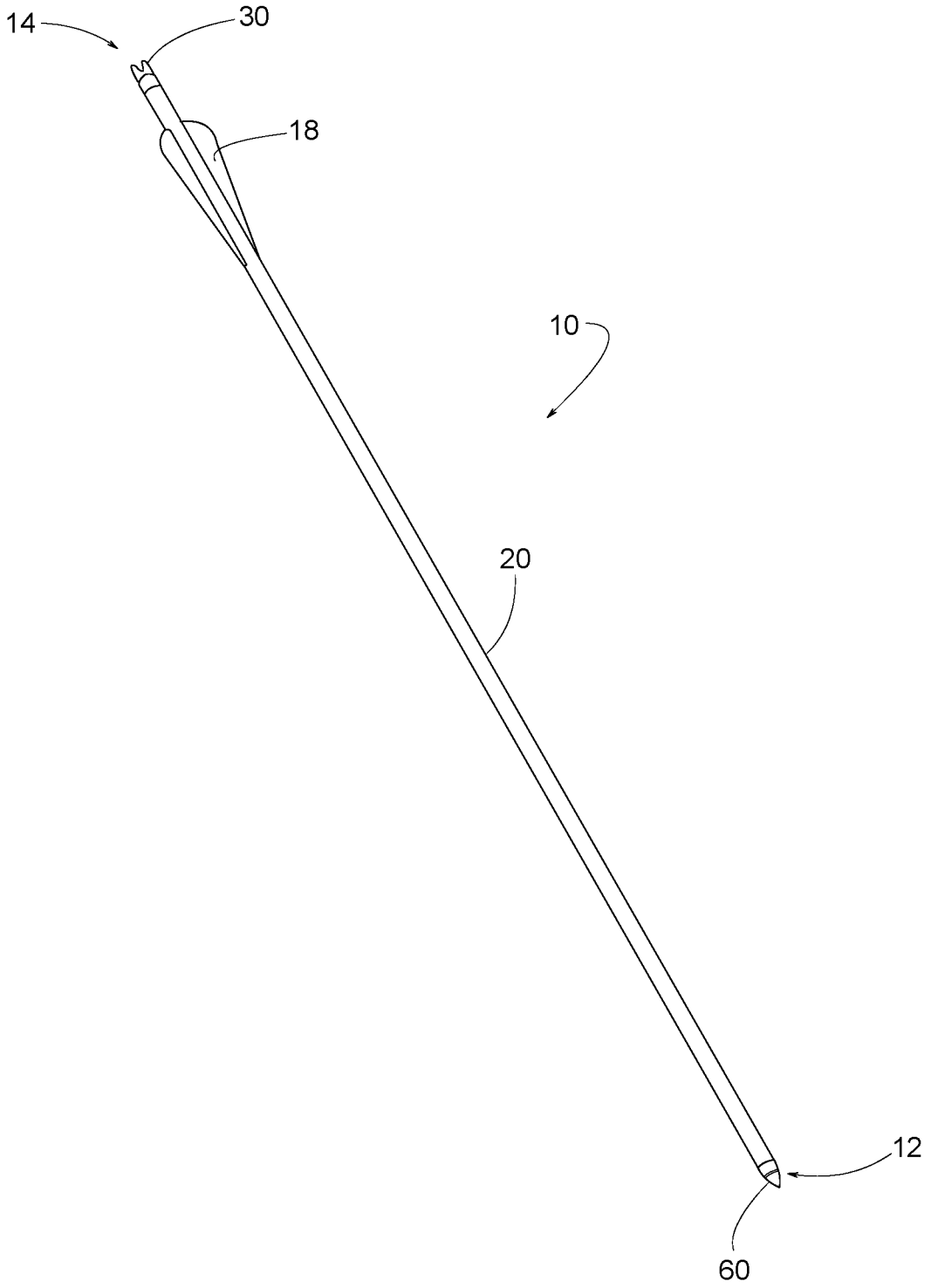
FIG. 1 shows an embodiment of an arrow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an arrow 10. In some embodiments, an arrow 10 comprises a tip 60, a shaft 20 and a nock 30. In some embodiments, the shaft 20 comprises an internal cavity, and the arrow 10 comprises a first vent 12 in fluid communication with the internal cavity and a second vent 14 in fluid communication with the internal cavity. In some embodiments, the first vent 12 comprises an inlet and the second vent comprises an outlet. In some embodiments, the arrow 10 comprises a vented arrow and the vents 12, 14 influence drag and flight characteristics of the arrow 10.

Figure 2:
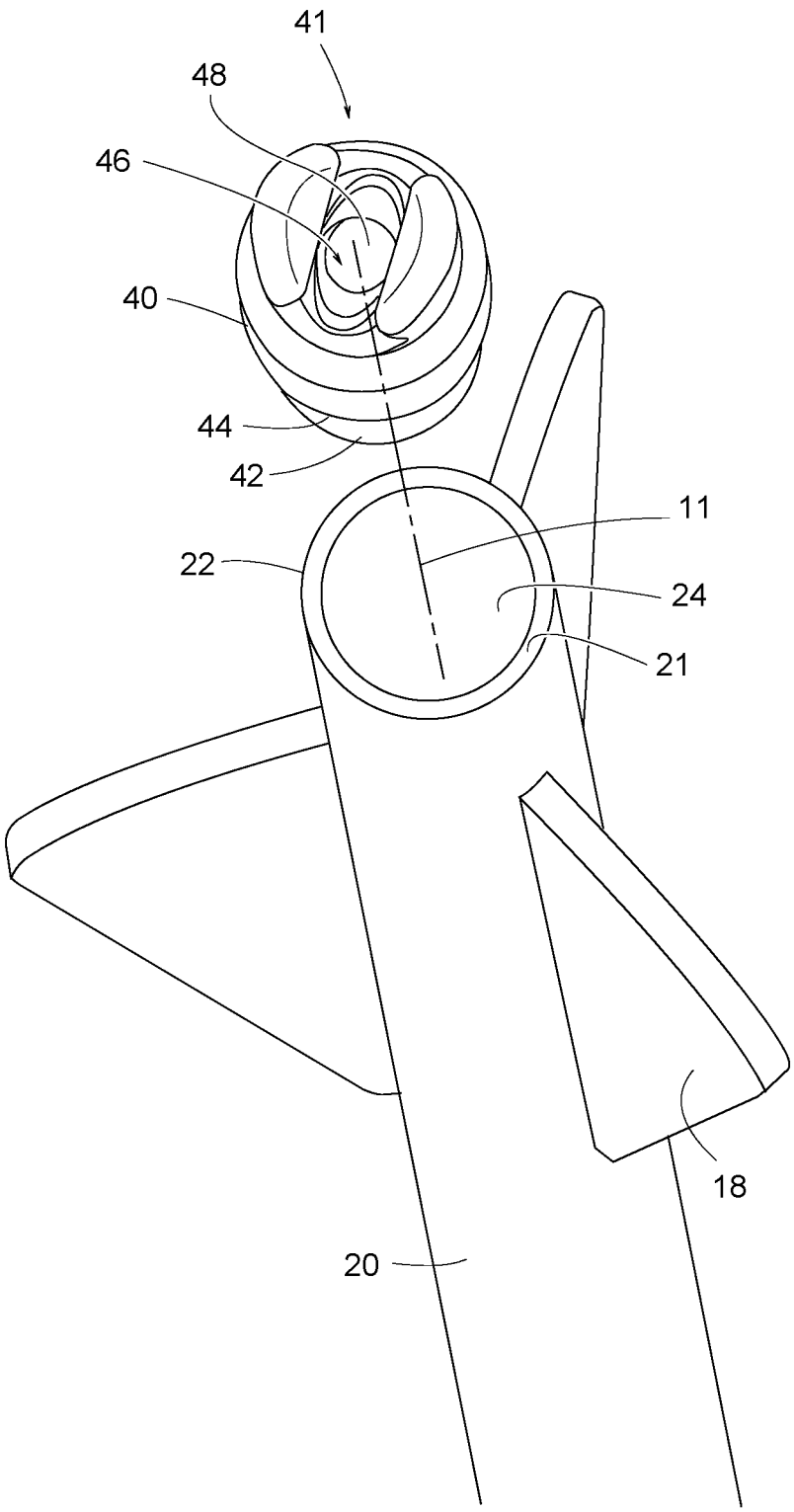
FIG. 2 shows an exploded view of the arrow of FIG. 1.
Figure 3:
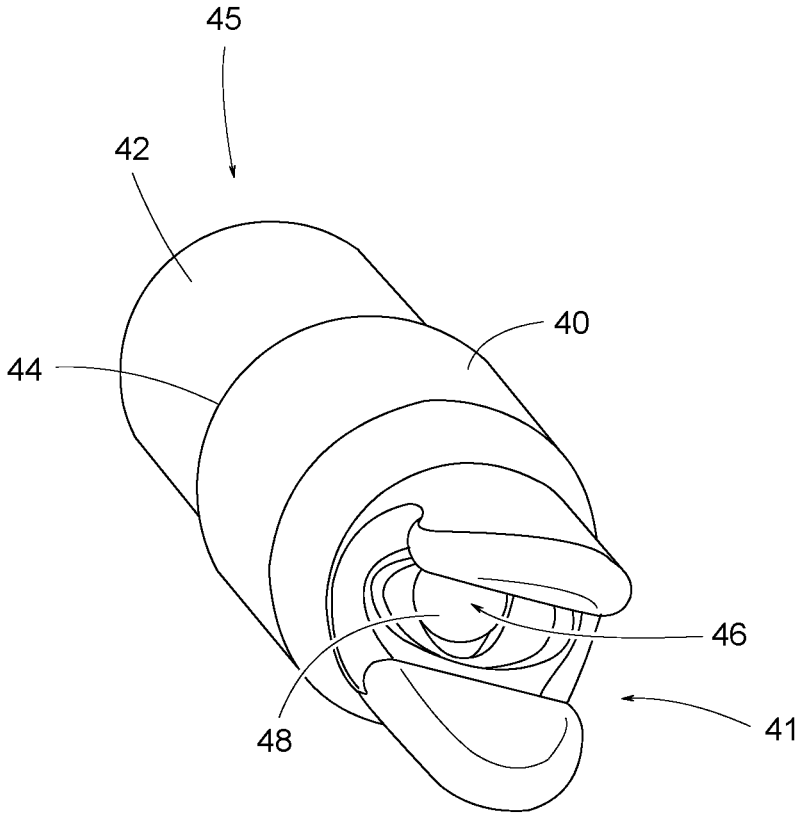
FIGS. 3-5 show an embodiment of a nock.
Figure 5:
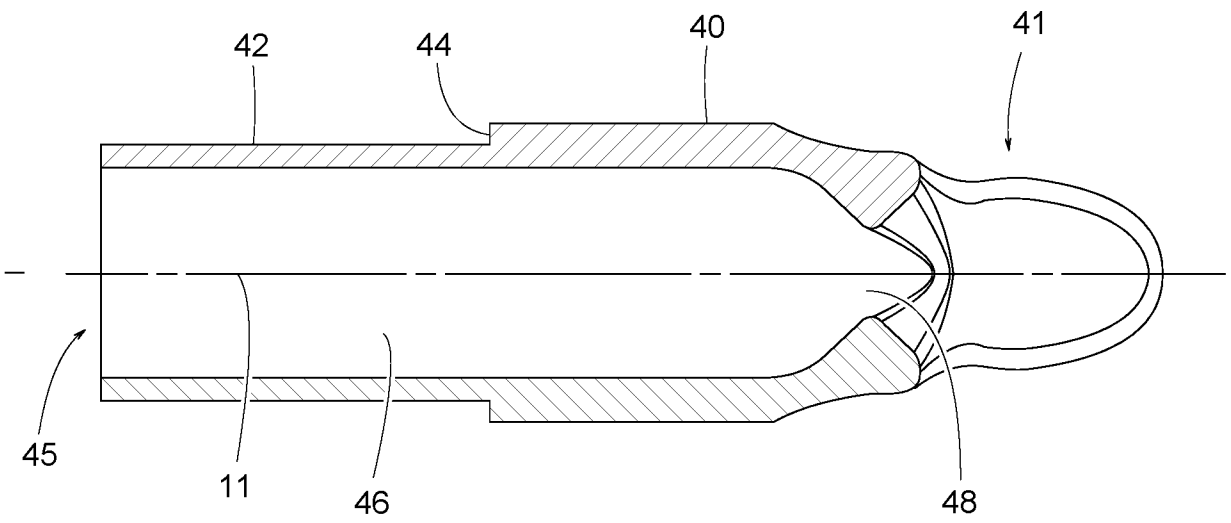
Figure 4:
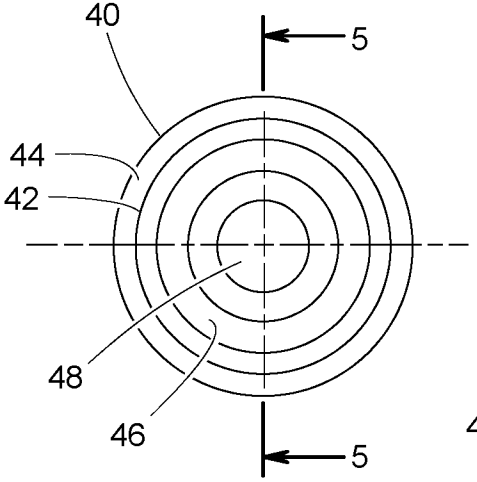

FIG. 2 shows an exploded view of the arrow 10 of FIG. 1. FIG. 3 shows an angled view of the embodiment of a nock 40 shown in FIG. 1. FIG. 4 shows an end view of the embodiment of the nock 40, and FIG. 5 shows a sectional view.

In some embodiments, the shaft 20 comprises a tube 22 comprising a cavity 24. In some embodiments, the shaft 20 comprises a sidewall 21 defining an inner surface and an outer surface. In some embodiments, the shaft 20 comprises a circular cross-sectional shape.

In some embodiments, the nock 40 is attached to the shaft 20. In some embodiments, the nock 40 comprises a protrusion 42 arranged to extend into the arrow shaft 20. In some embodiments, the nock 40 comprises a flange 44 arranged to abut an end of the arrow shaft 20. In some embodiments, the nock 40 is sized to fit over the shaft 20, and a portion of the shaft 20 can be received in the nock 40. In some embodiments, the nock 40 comprises a notch 41 arranged to engage a bowstring.

In some embodiments, the nock 40 comprises a cavity 46. In some embodiments, the nock 40 comprises a vent 48 in fluid communication with the cavity 46. In some embodiments, the vent 48 comprises an exhaust outlet for the arrow 10.

In some embodiments, the nock 40 comprises an aperture 45 in fluid communication with the cavity 46. In some embodiments, the nock cavity 46 is in fluid communication with the shaft cavity 24. In some embodiments, the vent 48 is centered on a central axis 11 of the arrow 10. In some embodiments, the vent 48 is arranged to vent air exiting the cavity 46 into the notch 41.

Figure 6:
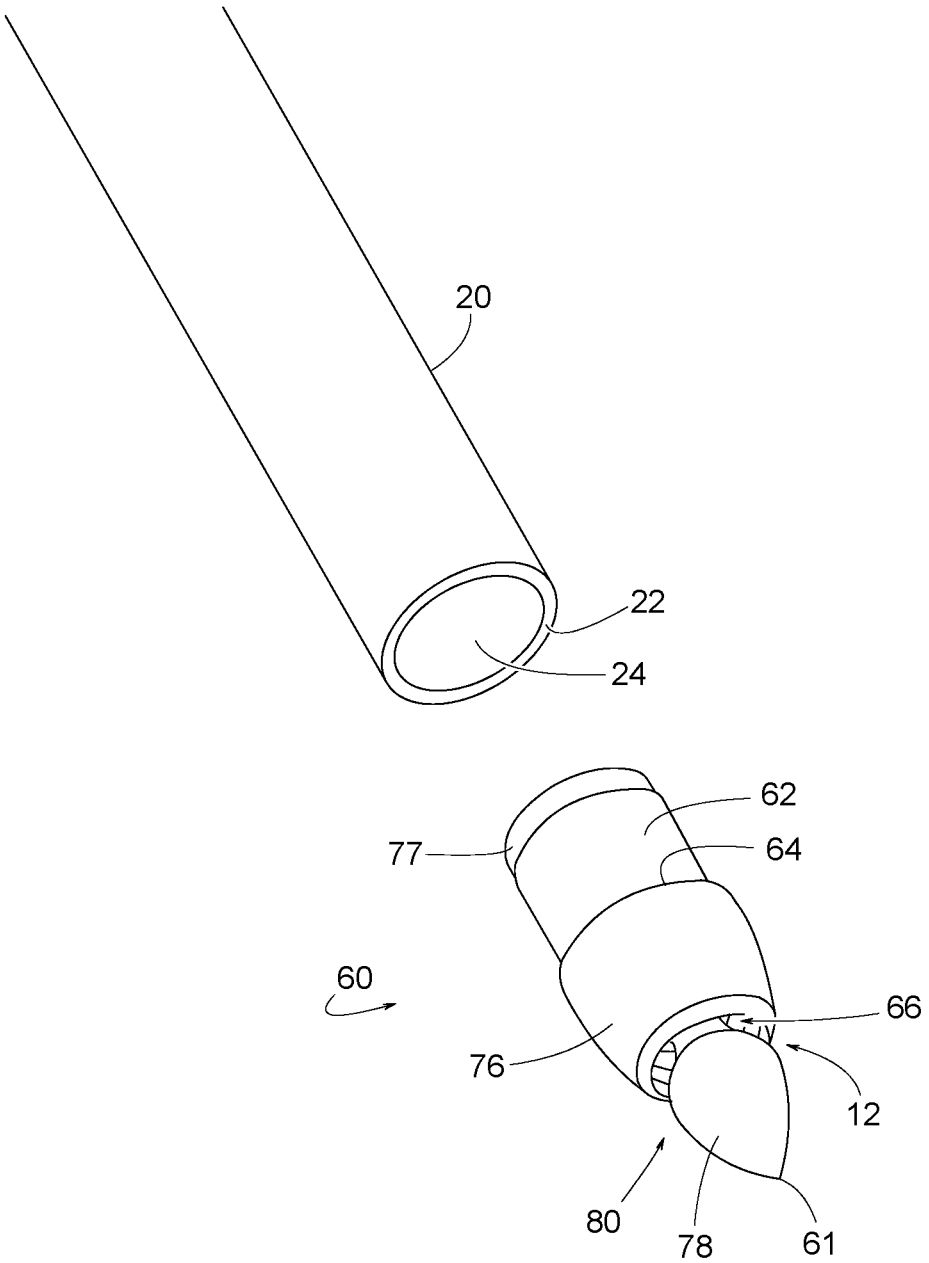
FIG. 6 shows another exploded view of the arrow of FIG. 1.
Figure 7:
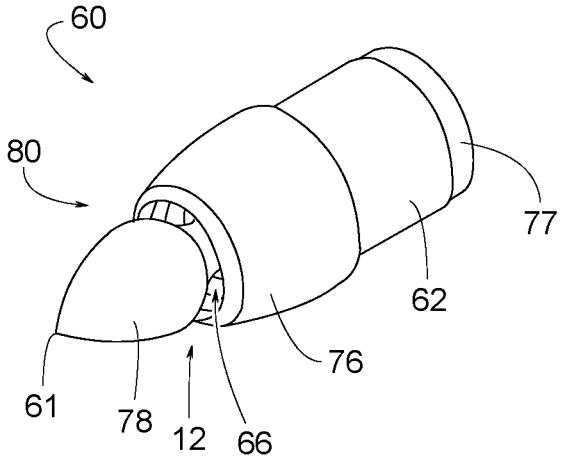
FIGS. 7-9 show an embodiment of a tip in a first configuration.
Figure 8:
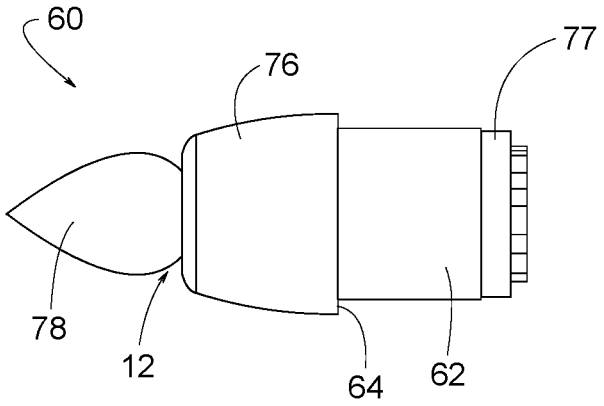
Figure 9:
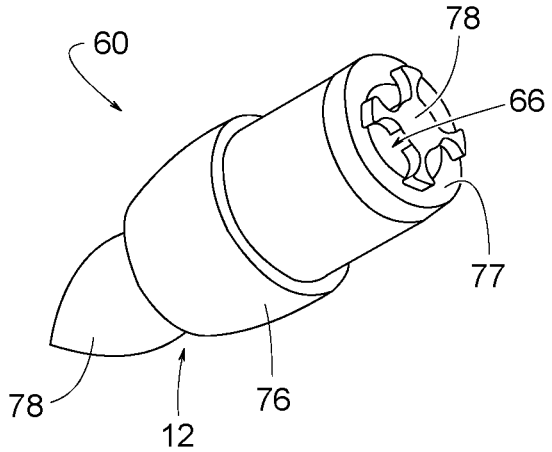
Figure 10:
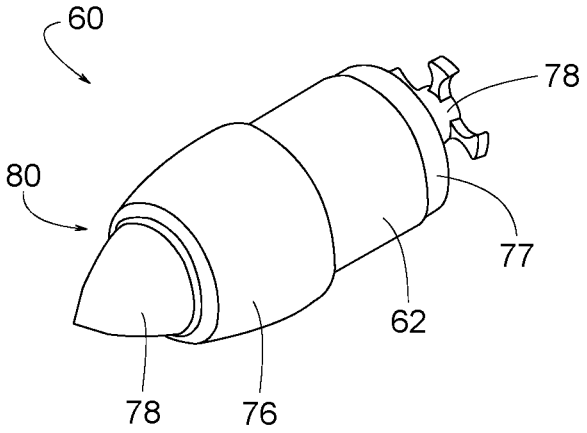
FIGS. 10-12 show the tip of FIGS. 7-9 in a second configuration.
Figure 11:
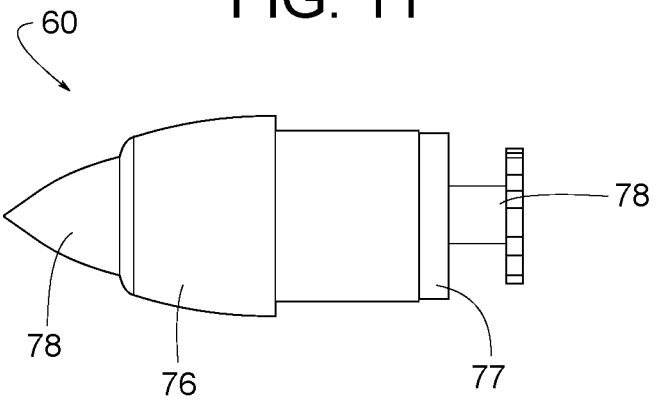
Figure 12:
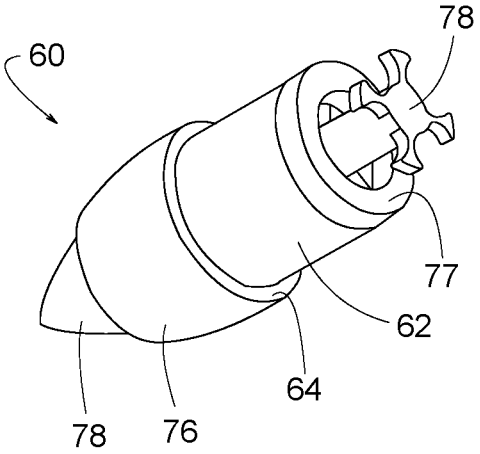
Figure 13:
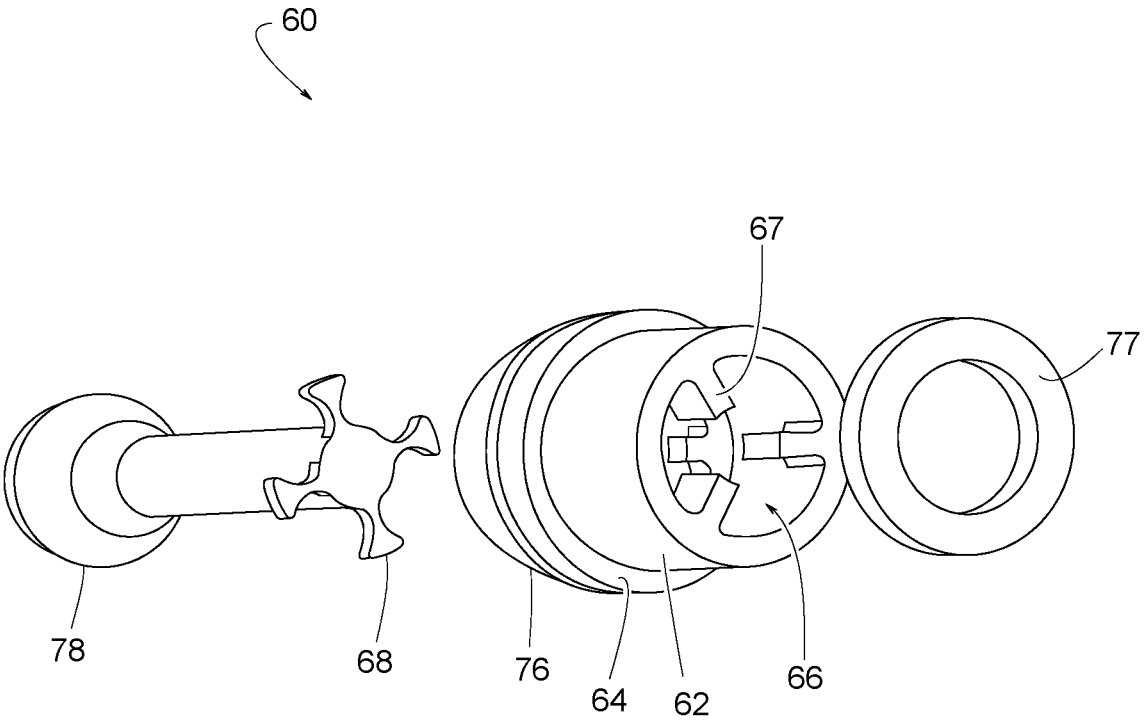
FIG. 13 shows an exploded view of the embodiment of a tip shown in FIGS. 7-12.
Figure 14:
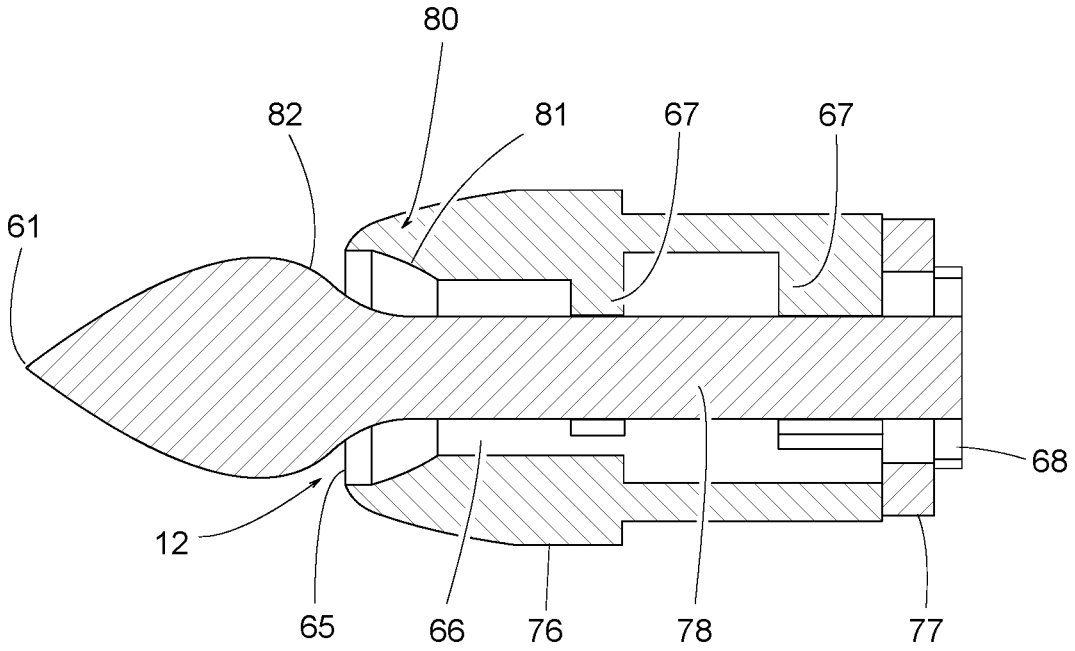
FIGS. 14 and 15 show sectional views of the embodiment of a tip shown in FIGS. 7-12.
Figure 15:
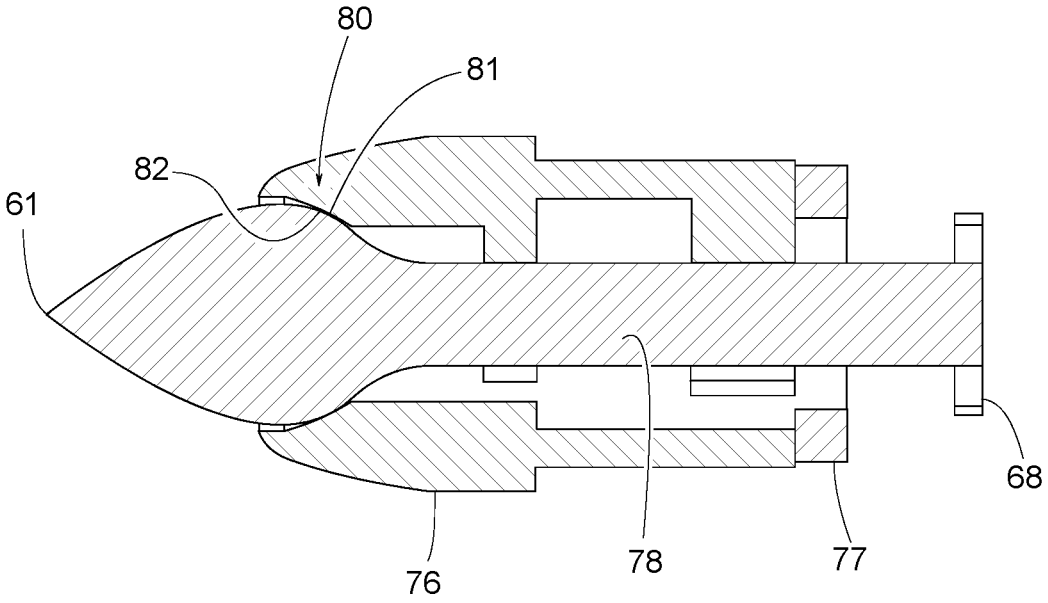

FIG. 6 shows an exploded view of the front portion of the arrow 10 shown in FIG. 1. FIGS. 7-9 show views of an embodiment of a tip 60 in a first orientation (e.g. open). FIGS. 10-12 show views of the embodiment of the tip 60 in a second orientation (e.g. closed). FIG. 13 shows an exploded view of the embodiment of the tip 60. FIG. 14 shows a sectional view of the embodiment of the tip 60 in the first orientation. FIG. 15 shows a sectional view of the embodiment of the tip 60 in the second orientation.

In some embodiments, the tip 60 is attached to the shaft 20. In some embodiments, the tip 60 comprises a protrusion 62 arranged to extend into the shaft 20. In some embodiments, the tip 60 comprises a flange 64 arranged to abut an end of the shaft 20. In some other embodiments, the tip 60 is sized to fit over the shaft 20, and a portion of the shaft 20 can be received in the tip 60.

In some embodiments, the tip 60 comprises a first vent 12. In some embodiments, the tip 60 comprises a cavity 66, and the first vent 12 is in fluid communication with the cavity 66. In some embodiments, the tip cavity 66 is in fluid communication with the shaft cavity 24, and the first vent 12 comprises an intake into the cavity 24.

In some embodiments, a tip 60 can have any suitable shape.

In some embodiments, a tip 60 comprises a first portion 76 and a second portion 78 moveable with respect to the first portion 76. In some embodiments, the first portion 68 comprises the cavity 66 and an aperture 65 into the cavity 66. In some embodiments, the aperture 65 comprises the first vent 12.

In some embodiments, the tip 60 comprises a valve 80. In some embodiments, the valve 80 is arranged to close the first vent 12. In some embodiments, the valve 80 comprises a seat 81 and a gate 82. In some embodiments, the first portion 76 comprises the seat 81 and the second portion 78 comprises the gate 82.

In some embodiments, the tip 60 comprises a first orientation of the first and second portions 76, 78 with respect to one another, for example as shown in FIGS. 7 and 14. In some embodiments, in the first orientation, the seat 81 is spaced away from the gate 82 and the valve 80 is open, allowing fluid flow through the first vent 12.

In some embodiments, the tip 60 comprises a second orientation of the first and second portions 76, 78 with respect to one another, for example as shown in FIGS. 10 and 15. In some embodiments, in the second orientation, the seat 81 contacts the gate 82 and the valve 80 is closed, thereby blocking fluid flow through the first vent 12.

In some embodiments, the tip 60 comprises a biasing member 77 arranged to bias the first portion 76 with respect to the second portion 78. In some embodiments, the biasing member 77 is arranged to bias the tip 60 to a particular orientation, such as the first (open) orientation. In some embodiments, a biasing member 77 comprises a spring. In some embodiments, the biasing member 77 comprises a magnet.

In some embodiments, the first portion 76 of the tip comprises a cavity 66 and the second portion 78 extends through the cavity 66. Desirably, the first portion 76 and second portion 78 are configured to allow fluid flow through the cavity 66 when the valve 80 is open.

In some embodiments, the first portion 76 comprises radial arms 67 that extend into the cavity 66 and position the second portion 78.

In some embodiments, the second portion 78 comprises extension arms 68 that extend outward from the second portion 78 and function as a stop, for example abutting the first portion 76. In some embodiments, the biasing member 77 engages the extension arms 68. In some embodiments, the extension arms 68 are magnetically attracted to a magnetic biasing member 77.

In some embodiments, the tip 60 is arranged to close when impacting a target. In some embodiments, a force applied to the point 61 of the second portion 78 will move the second portion 78 with respect to the first portion 76. In some embodiments, such a force will overcome the biasing member 7 and move the tip 60 to a second (closed) orientation. Thus, in some embodiments, an arrow 10 can function as a vented arrow during flight, and the first vent 12 can close when the arrow 10 impacts a target. This can prevent material from entering the first vent 12.

Figure 16:
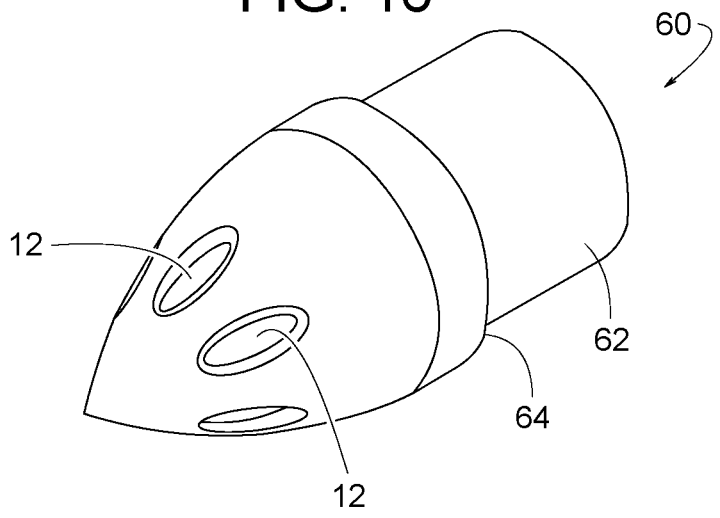
FIGS. 16-18 show another embodiment of a tip.
Figure 17:
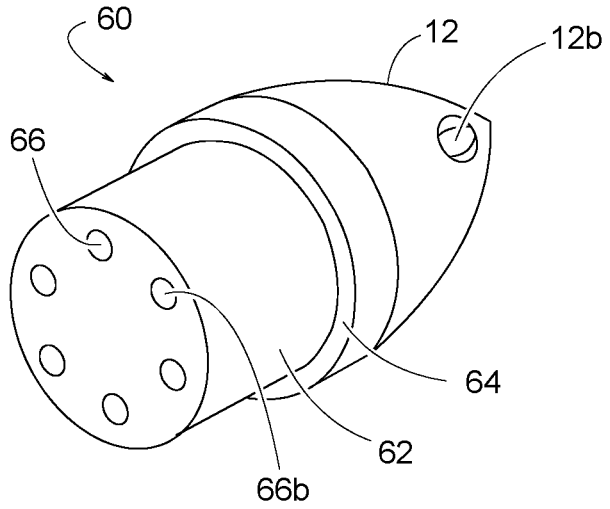
Figure 18:
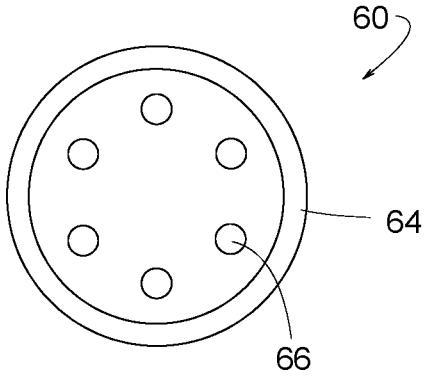
Figure 19:
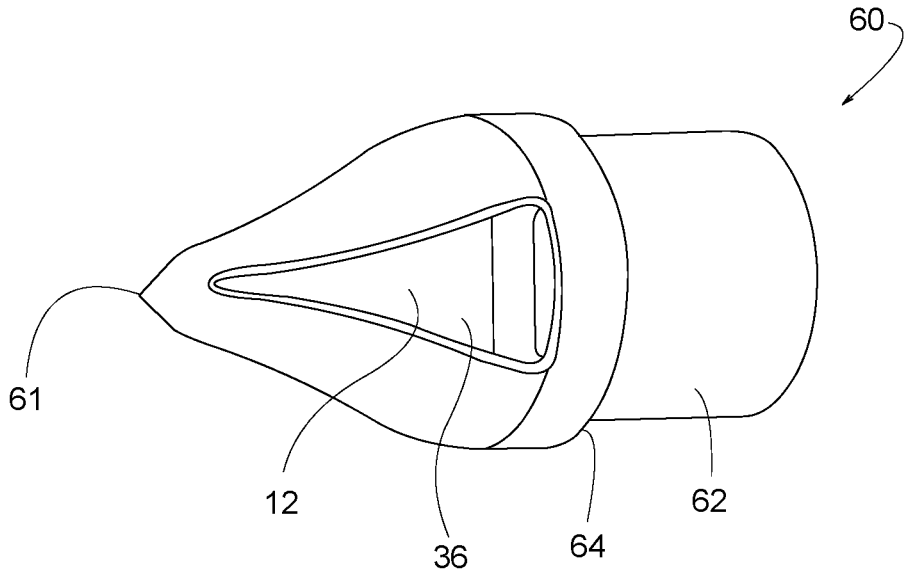
FIGS. 19-22 show another embodiment of a tip.
Figure 20:
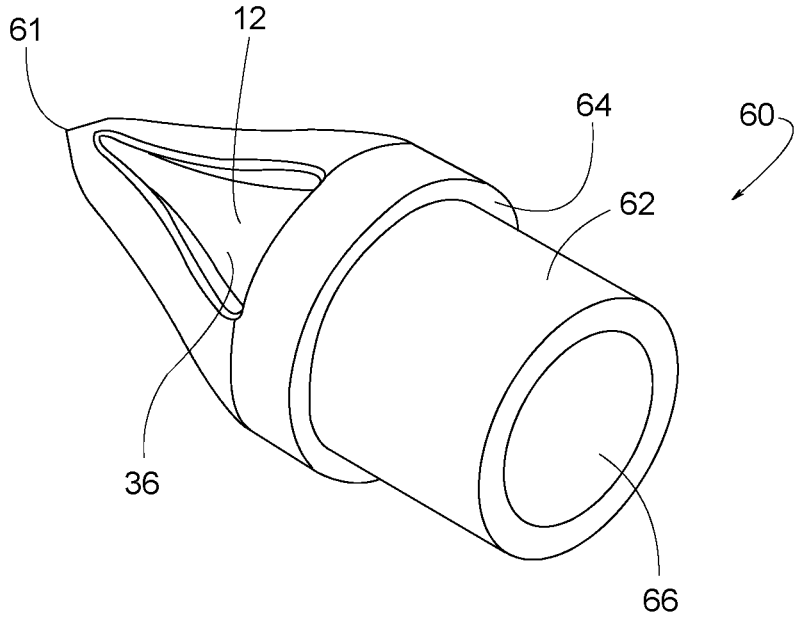
Figure 21:
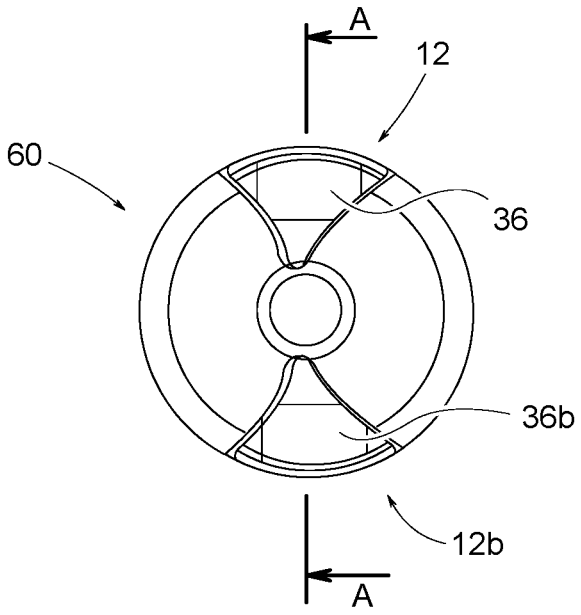
Figure 22:
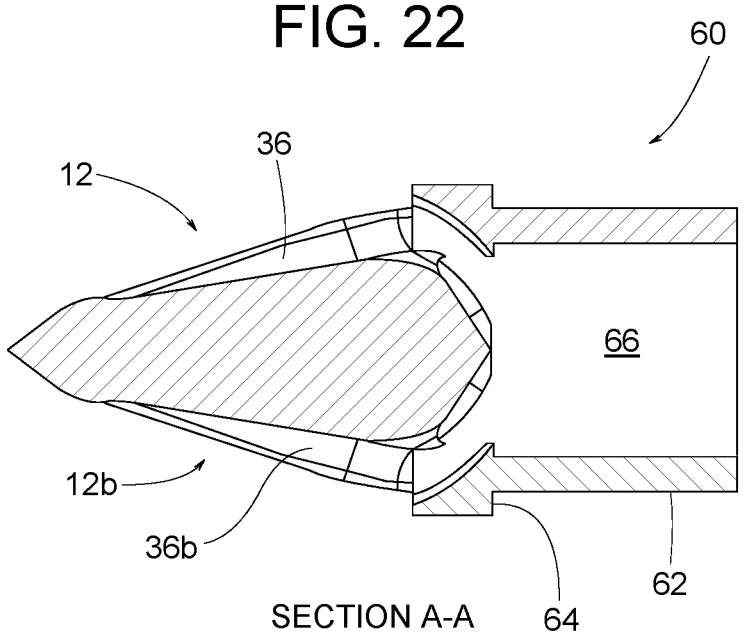
Figure 23:
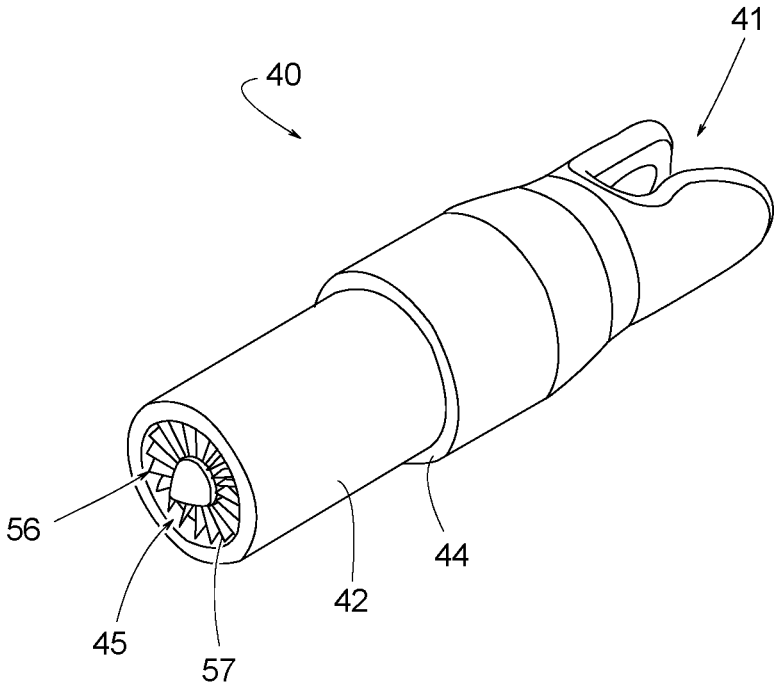
FIGS. 23-26 show another embodiment of a nock.
Figure 24:
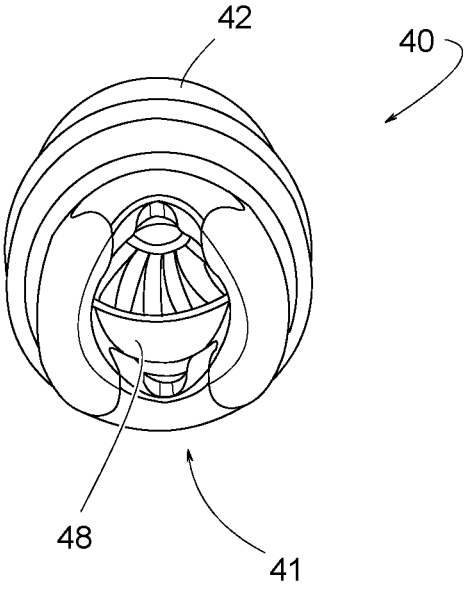
Figure 26:
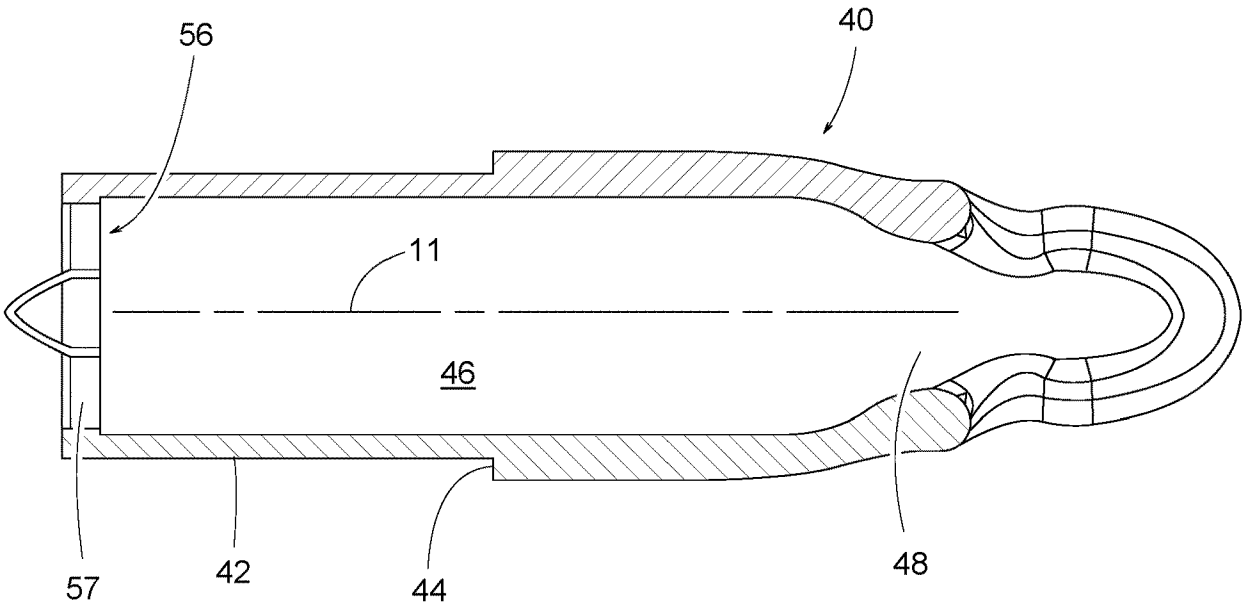
Figure 25:
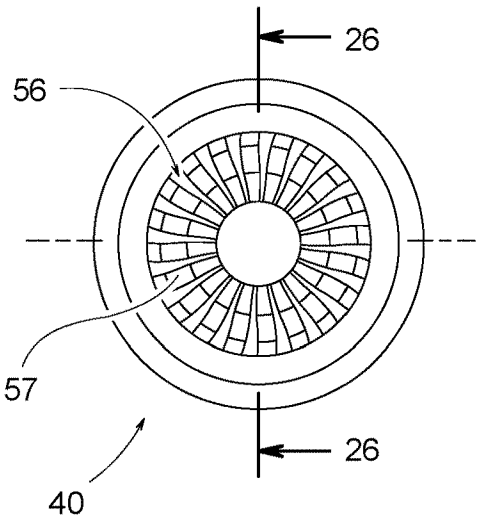
Figure 27:
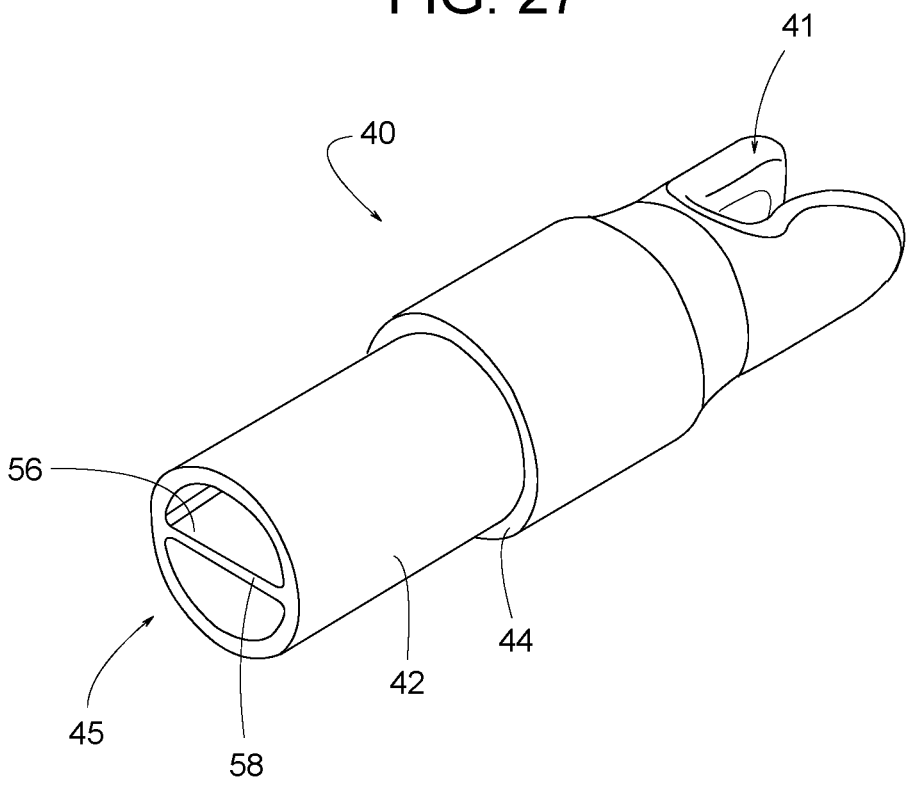
FIGS. 27-30 show another embodiment of a nock.
Figure 28:
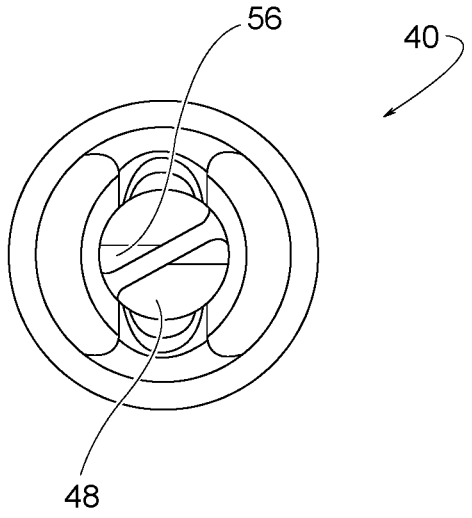
Figure 30:
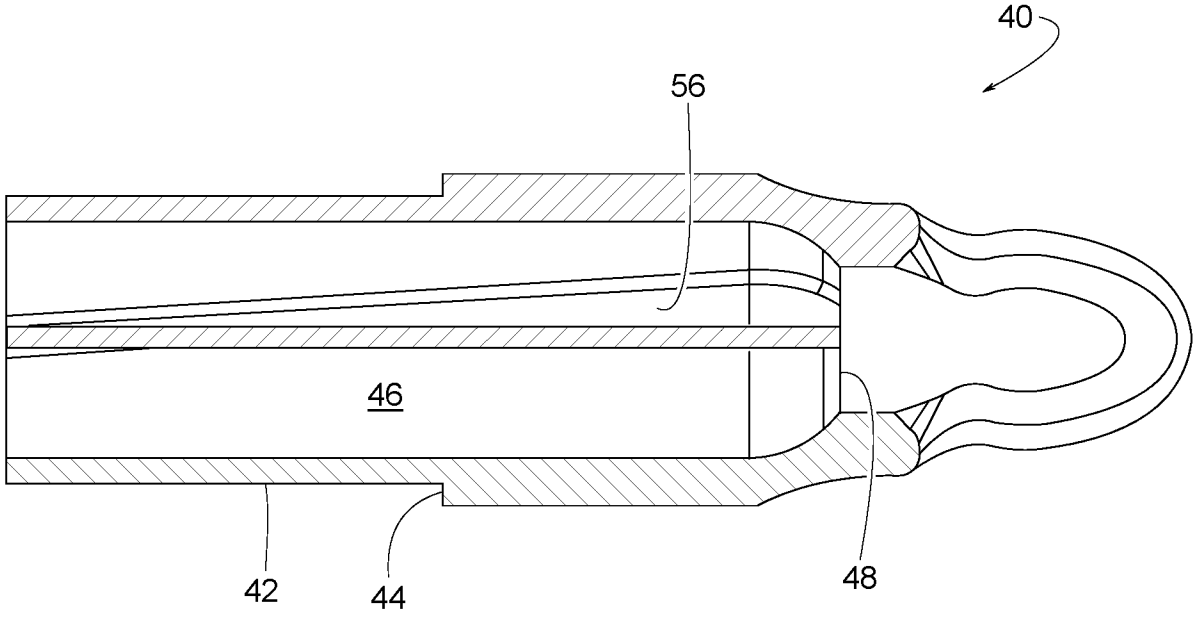
Figure 29:
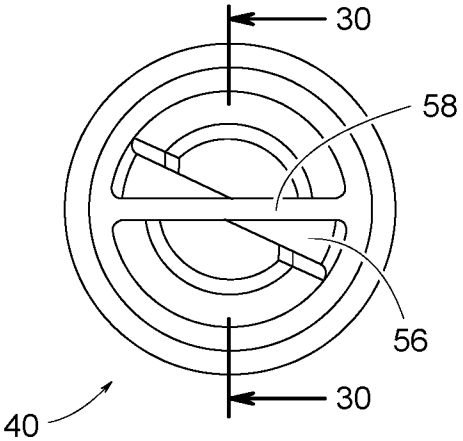

FIGS. 16-18 show another embodiment of a tip 60. In some embodiments, a tip 60 comprises a first vent 12 and an associated cavity 66 that define a flowpath through the tip 60. In some embodiments, the tip 60 comprises another first vent **12*b* and an associated cavity 66*b* that define another flowpath through the tip 60. In various embodiments, a tip 60 can comprise any suitable number of first vents 12, 12*b*, etc., and any suitable number of cavities 66, 66*b***, etc.

In some embodiments, a first cavity 66 and a second cavity **66*b*** are not in fluid communication with one another.

In some embodiments (not illustrated), a cavity 66 can comprise multiple vents 12 into the cavity. In some embodiments, the tip 60 comprises a body defining a large cavity 66, and multiple vents 12 are in fluid communication with the cavity 66.

FIGS. 19-22 show another embodiment of a tip 66. In some embodiments, a first vent 12 comprises a contoured shape that provides a low-drag inlet. In some embodiments, the first vent 12 comprises a shape that increases cross-sectional area as a length of the first vent 12 is traversed. In some embodiments, a width of the first vent 12 increases as a length of the first vent 12 is traversed. In some embodiments, a depth of the first vent 12 increases as a length of the first vent 12 is traversed.

In some embodiments, a first vent 12 comprises a NACA duct 36. In some embodiments, a tip 60 comprises a plurality if NACA duct 36 inlets.

FIGS. 23-26 show another embodiment of a nock 40. In some embodiments, a nock 40 comprises a cavity 46 and defines a flowpath as described herein, and further comprises a turbine 56 positioned in the flowpath. In some embodiments, a turbine 56 comprises a plurality of blades 57. In some embodiments, a turbine 56 is centered on a central axis 11. In some embodiments, the turbine 56 is fixedly attached to the nock 40.

In some embodiments, a turbine 56 generates rotational forces that encourage the attached structure to rotate about the longitudinal axis 11. Thus, as fluid passes through the nock 40 and over the turbine 56, the turbine 56 generates forces that encourage the nock 40 (and an attached arrow) to rotate about the longitudinal axis 11. In some embodiments, the turbine 56 provides spin-stabilization for the arrow 10.

In some embodiments, an arrow 10 excludes vanes 18 (see e.g. FIG. 1).

FIGS. 27-30 show another embodiment of a nock 40, showing another embodiment of a turbine 56. In some embodiments, a turbine 56 comprises a crossmember 58 that extends across the cavity 46. In some embodiments, the crossmember 58 comprises a contoured shape that provides a deflecting surface.

Figure 31:
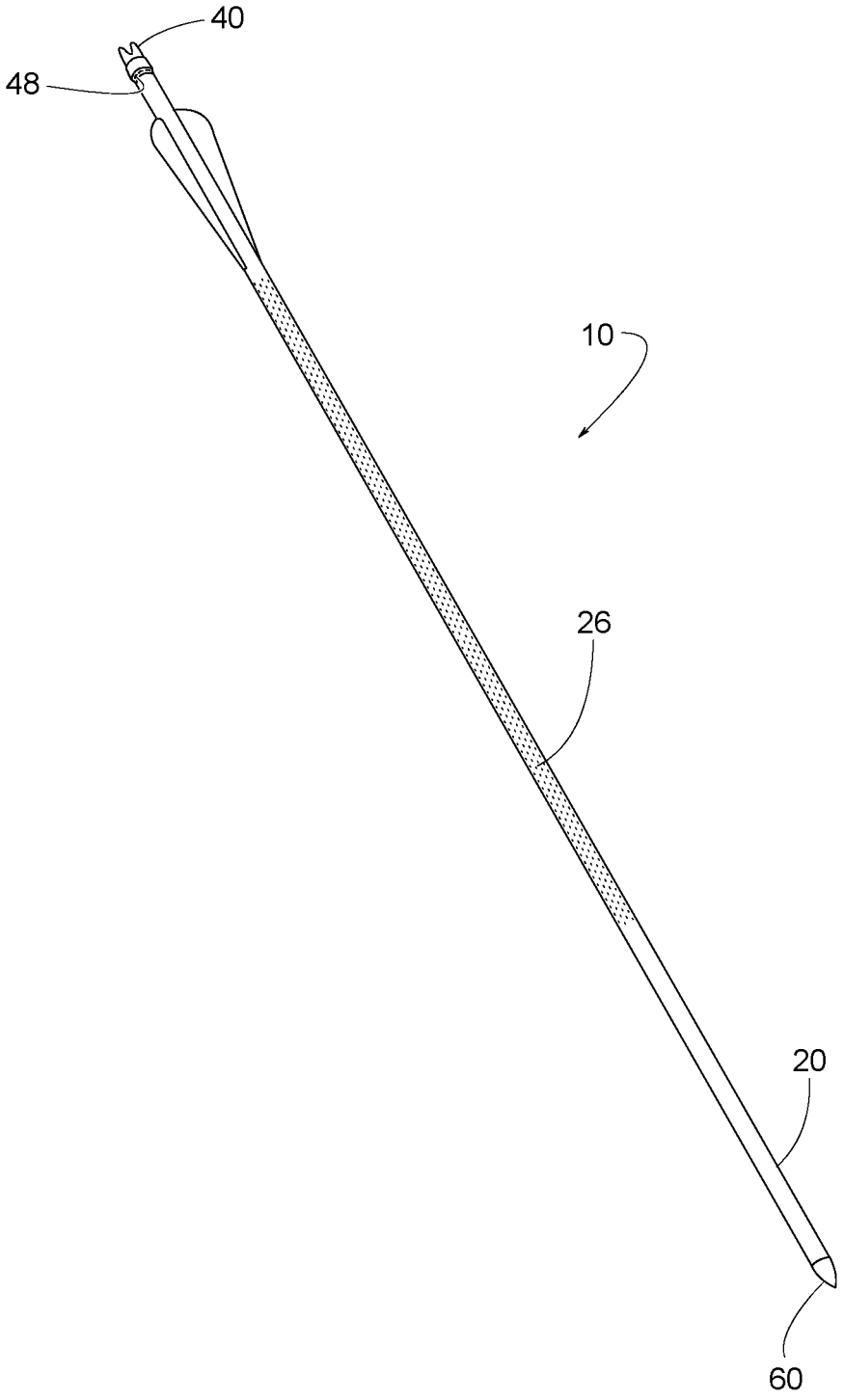
FIG. 31 shows another embodiment of an arrow.
Figure 32:
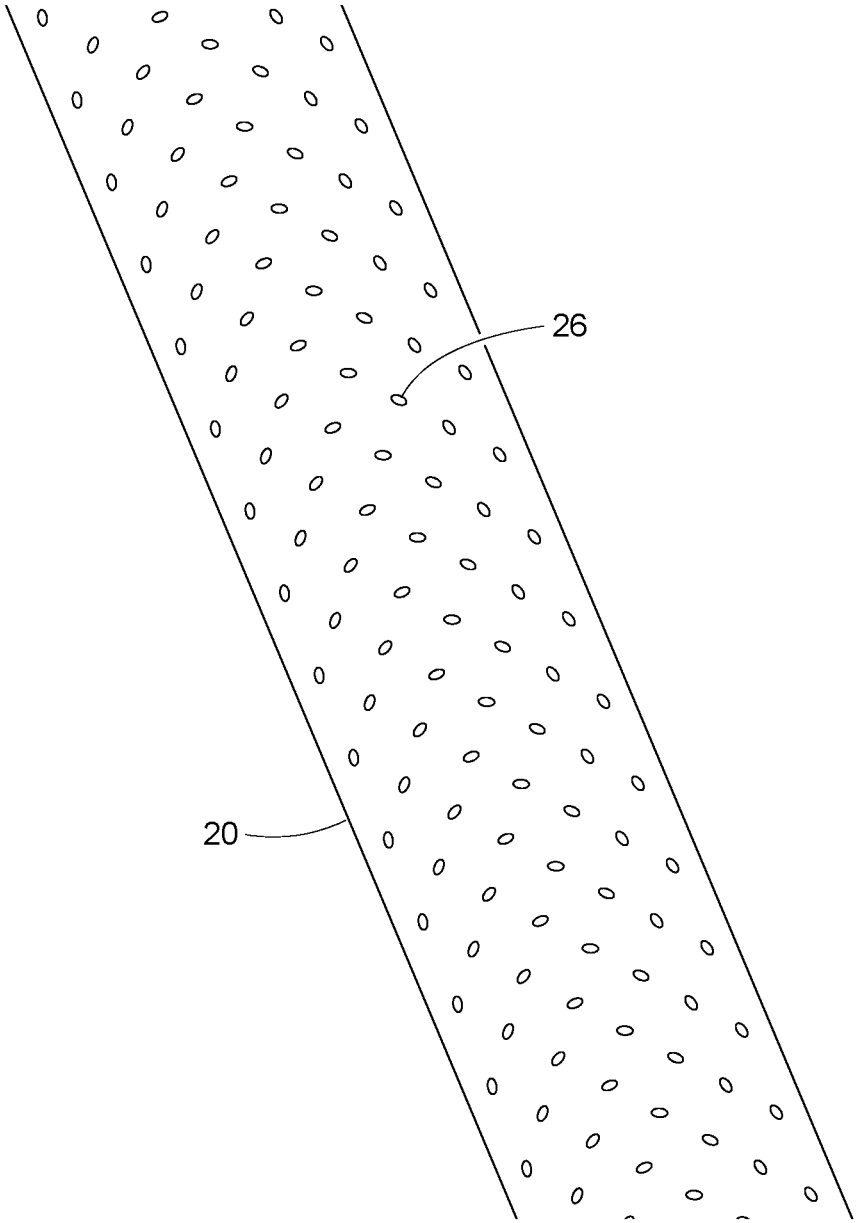
FIG. 32 shows an embodiment of a shaft.
Figure 35:
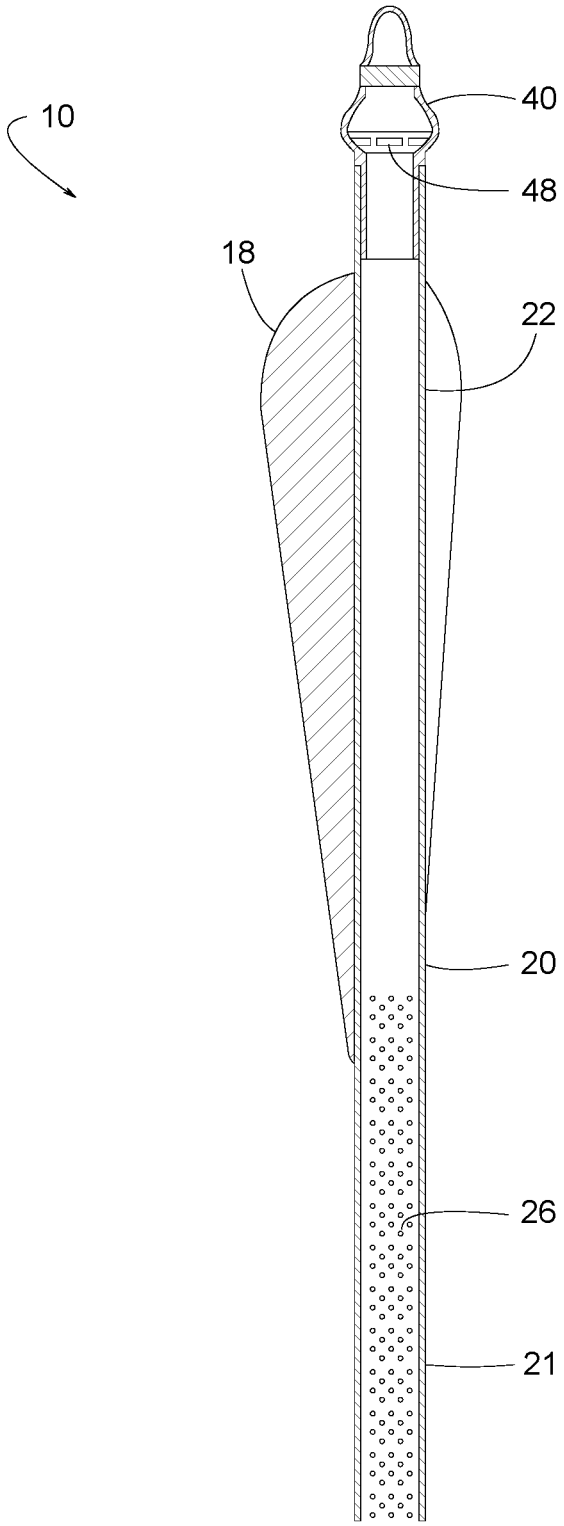
FIG. 35 shows a sectional view of the embodiment of an arrow shown in FIG. 31.
Figure 36:
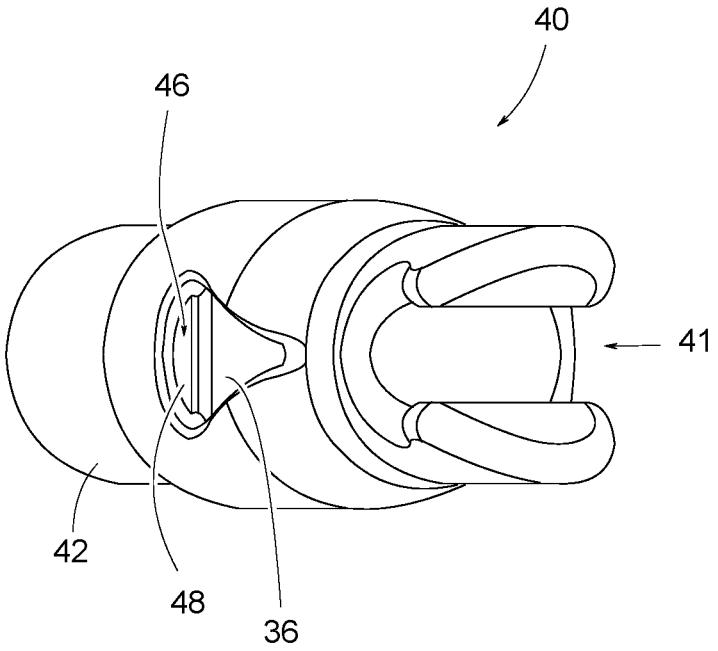
FIGS. 36-39 show another embodiment of a nock.
Figure 37:
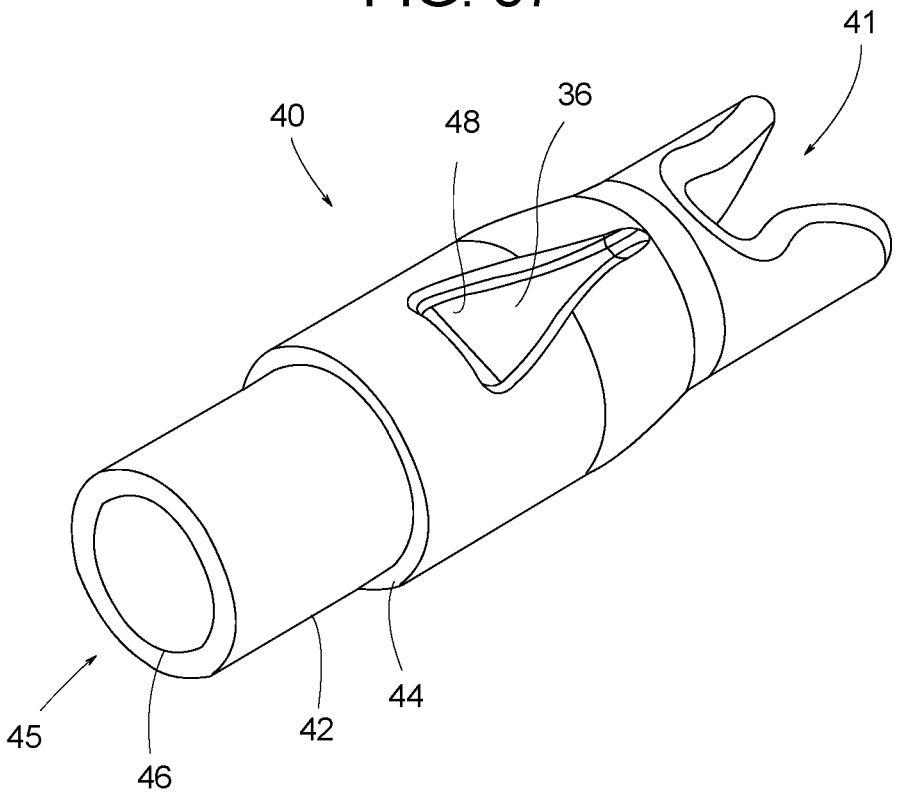
Figure 39:
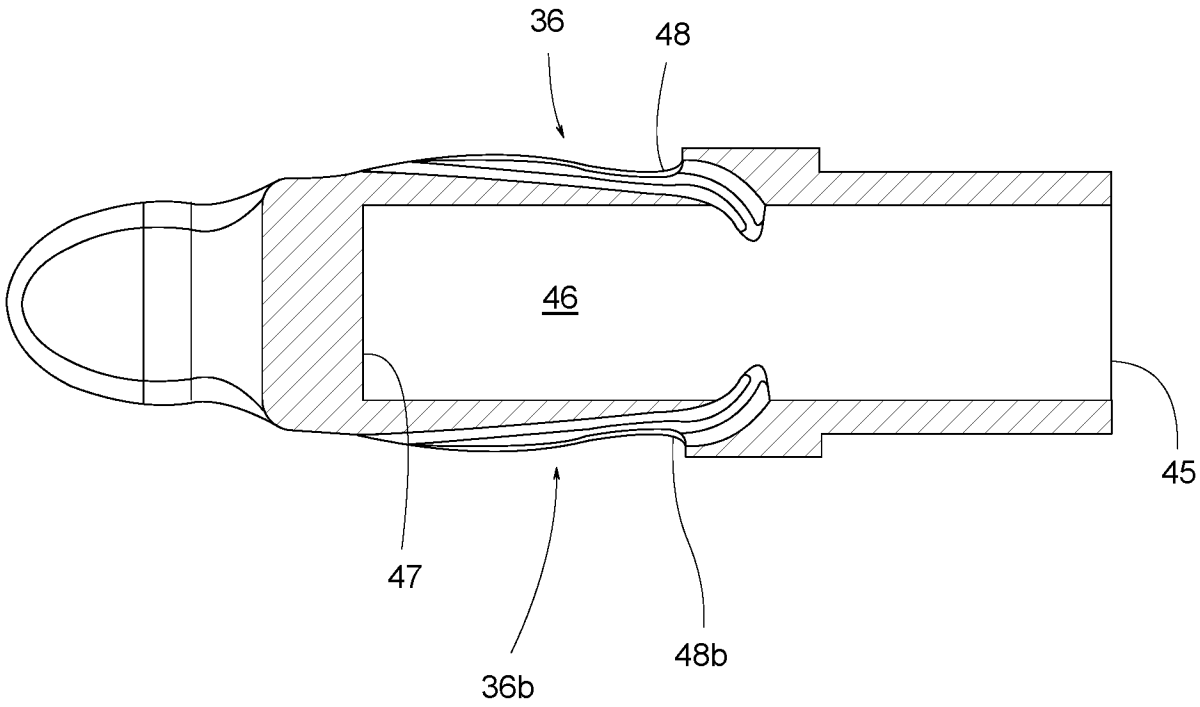
Figure 38:
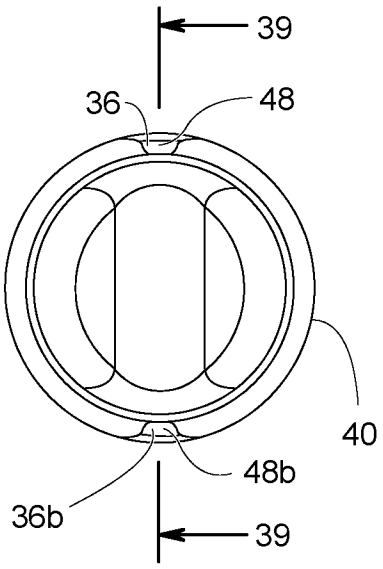

FIG. 31 shows another embodiment of an arrow 10. FIG. 32 shows the shaft 20 of FIG. 31 in greater detail, and FIG. 35 shows a sectional view. In some embodiments, the shaft 20 comprises an internal cavity and a plurality of apertures 26 in fluid communication with the internal cavity. In some embodiments, each aperture 26 extends through a sidewall of the shaft 20. In some embodiments, the apertures 26 are arranged in a repeating pattern across any suitable area portion of the shaft 20. The apertures 26 can be arranged in any suitable pattern and have any suitable spacing. The apertures 26 can be arranged in a grid pattern. In some embodiments, the apertures 26 are arranged in groups of different grid patterns. In some embodiments, apertures 26 are arranged in a helical spiral that extends along the length of the shaft 20. The apertures 26 can have any suitable size. In some embodiments, the apertures 26 have a common size. In some embodiments, different apertures 26 can have different sizes. The various apertures 26 can have any suitable arrangement on the shaft 20. In some embodiments, the apertures 26 allow fluid to flow into or out of the shaft 20. In some embodiments, the apertures 26 allow fluid to exit the shaft 20 and form a boundary layer around the arrow 10 that enhances arrow flight.

FIG. 31 shows a solid tip 60, which does not include apertures or venting. FIG. 31 shows an embodiment of a nock 40 comprising a vent 48. In some embodiments, the vent 48 of a nock 40 comprises at inlet.

Figure 33:
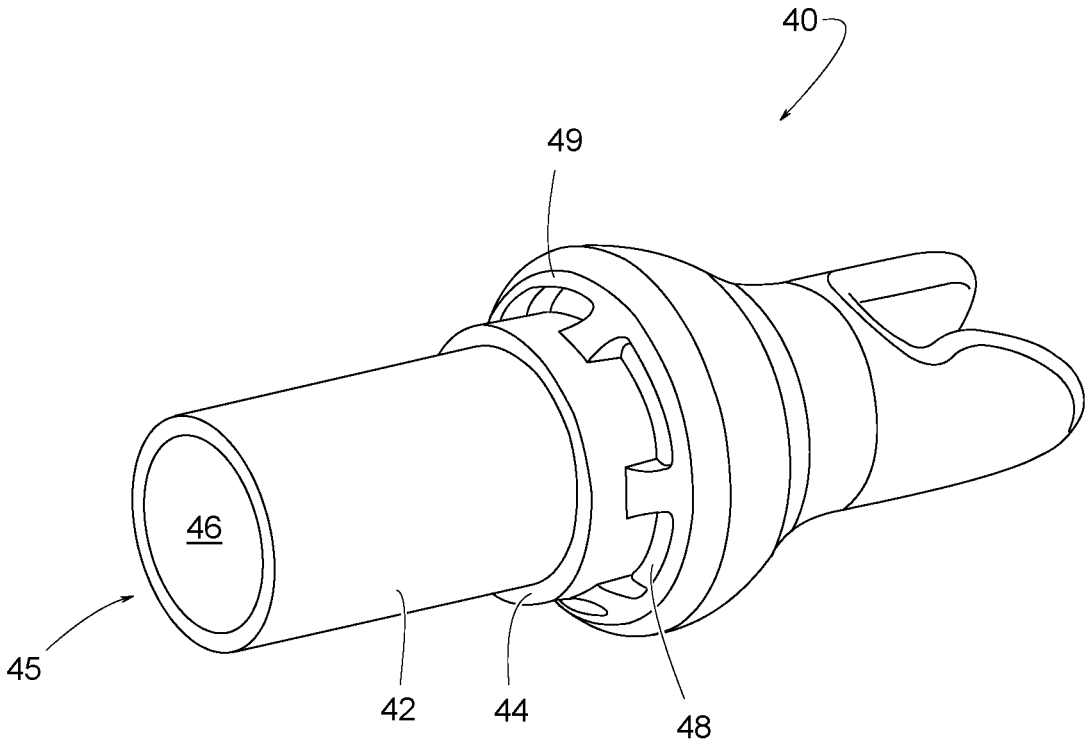
FIGS. 33 and 34 show another embodiment of a nock.
Figure 34:
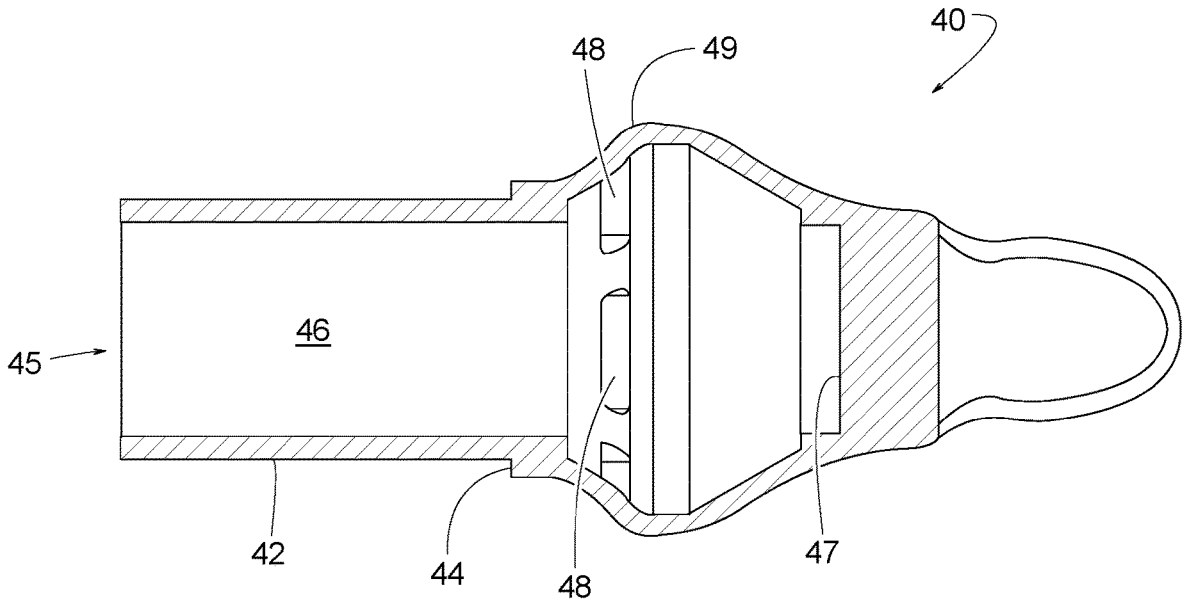

FIGS. 33 and 34 show the nock 40 of FIG. 31 in greater detail. In some embodiments, the nock 40 comprises a body that increases in size behind the arrow shaft 20. Thus, in some embodiments, the nock 40 comprises a protrusion 42 arranged to be received in the shaft 20 and a flange 44 arranged to abut the shaft 22. In some embodiments, the nock 40 comprises a protruding surface 59 that extends outwardly from the flange 44. In some embodiments, the protruding surface 59 comprises a larger dimension, such as a larger diameter, than the flange 44. In some embodiments, the protruding surface 59 comprises one or more vents 48.

In some embodiments, the nock 40 comprises raised vents 48 that are positioned in the fluid flowpath radially outwardly above an outer surface of the shaft 20. In some embodiments, the cavity 46 comprises a sealed back wall 47, so fluid will enter the cavity 46 via the vents 48 and will exit the cavity via the forward aperture 45. Thus, in some embodiments, the nock 40 comprises a fluid intake that provides fluid to an internal cavity of the shaft 20. In some embodiments, the fluid exits the shaft 20 via the apertures 26 and forms a boundary layer around the shaft 20.

FIGS. 36-39 show another embodiment of a nock 40. In some embodiments, a nock 40 comprises one or more vents 48, 48*b* in fluid communication with the cavity 46. In some embodiments, a vent 48 comprises a NACA duct 36. In some embodiments, the cavity 46 comprises a sealed back wall 47 and the vent(s) 48 are located on side portion(s) of the nock 40.

Figure 40:
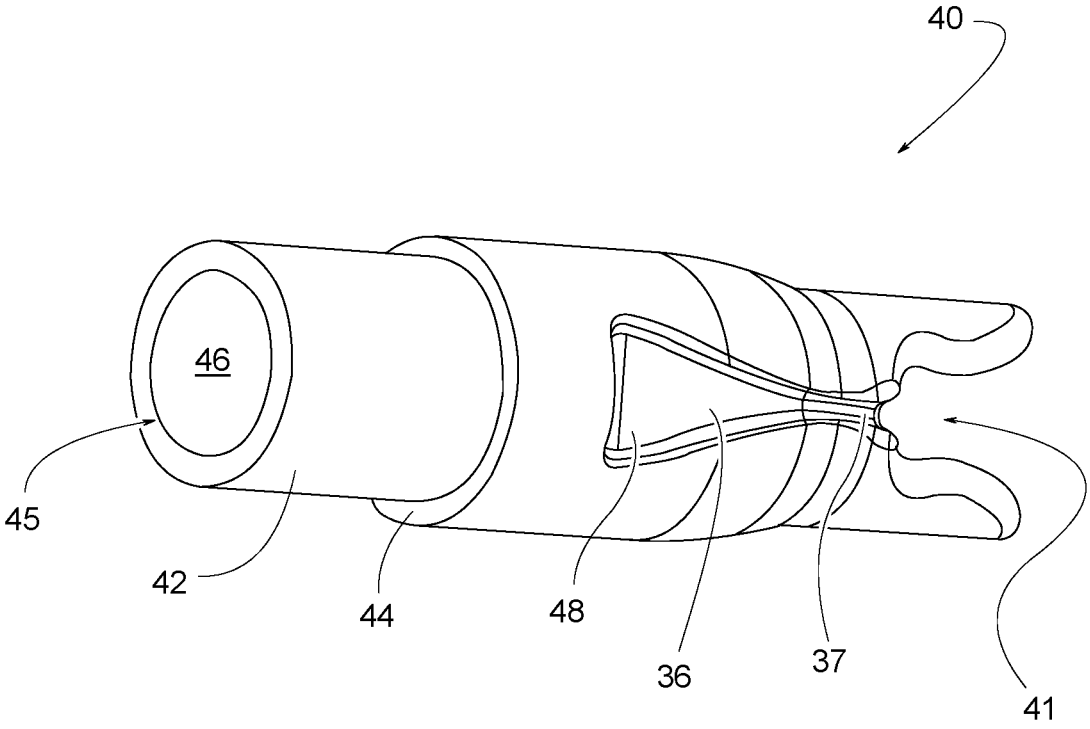
FIGS. 40 and 41 show another embodiment of a nock.
Figure 41:
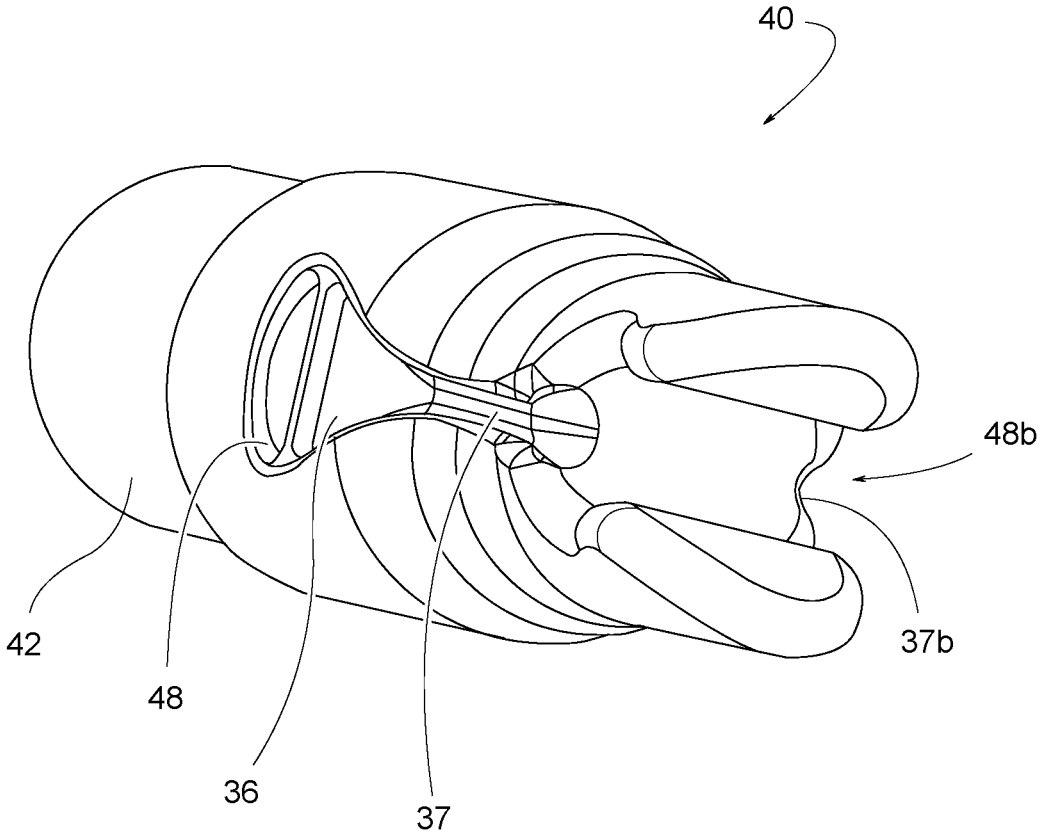

FIGS. 40 and 41 show another embodiment of a nock 40. In some embodiments, a nock 40 comprises one or more vent(s) 48 that comprise a NACA duct 36. In some embodiments, a NACA duct 36 comprises sidewalls that define a groove 37. In some embodiments, the groove 37 extends to the notch 41 of the nock 40.

Figure 42:
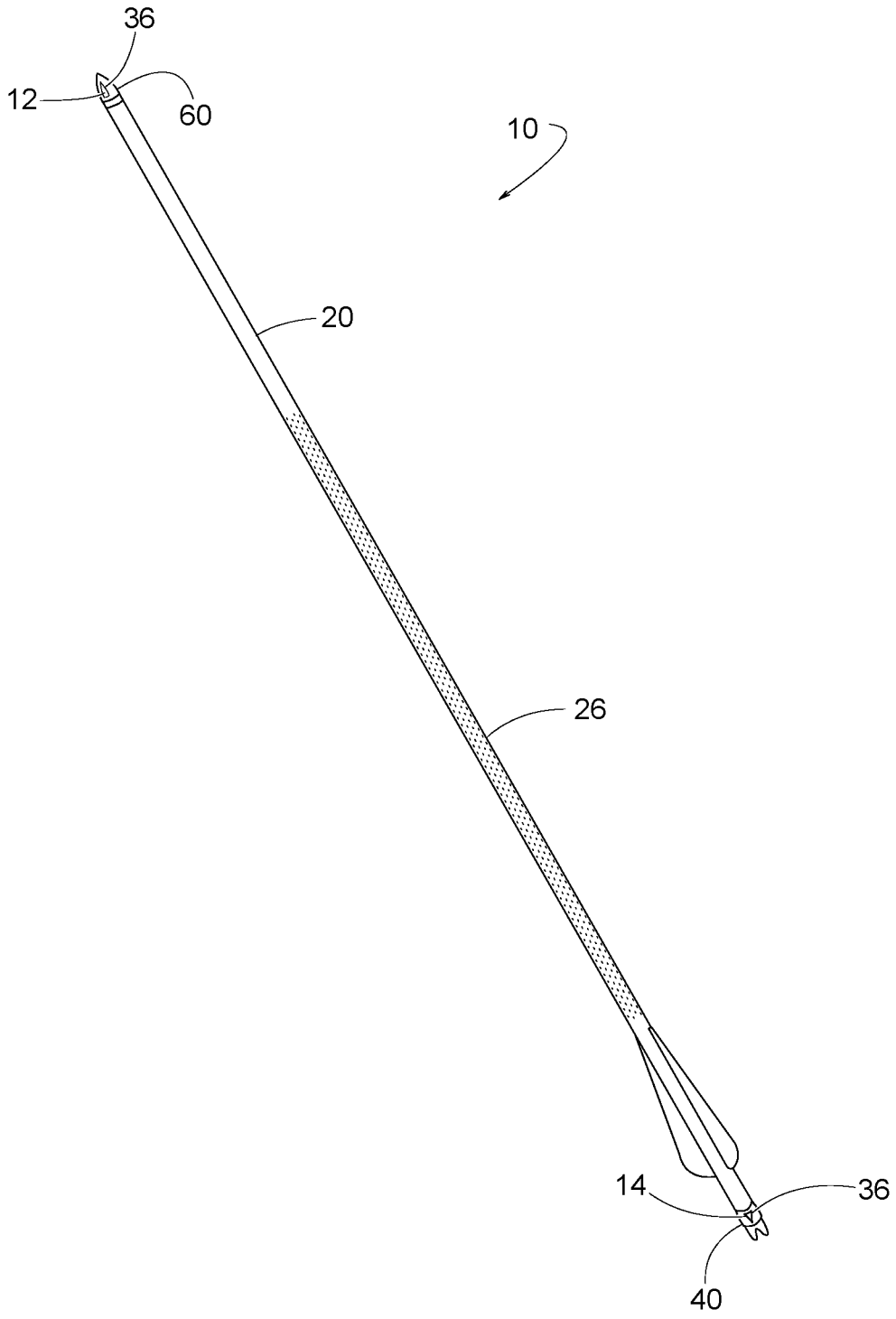
FIG. 42 shows another embodiment of an arrow.

FIG. 42 shows another embodiment of an arrow 10. In some embodiments, an arrow 10 comprises a tip 60 comprising a vent 12. In some embodiments, the vent 12 comprises a NACA duct 36. In some embodiments, an arrow 10 comprises a nock 40 comprising a vent 14. In some embodiments, the vent 14 comprises a NACA duct 36. In some embodiments, the shaft 20 comprises apertures 26 arranged in a repeating pattern.

In various embodiments, an arrow 10 can comprise any suitable combination of the shaft 20, tip 60 and nock 40 embodiments disclosed herein. Different combinations can present different fluid flow specifics. In some embodiments, fluid (e.g. air) enters the tip 60, travels through the shaft 20 and exits via a shaft aperture 26. In some embodiments, fluid enters the tip 60, travels through the shaft 20 and exits via a vent 14 in the nock 40. In some embodiments, fluid enters the nock 40, travels in a forward direction down the shaft 20 and exits via a shaft aperture 26.

Any suitable combination of the shaft 20, tip 60 and nock 40 embodiments disclosed herein to produce desired fluid flow arrangements.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An arrow comprising:

a shaft comprising a tubular wall comprising a cavity;

a nock comprising a notch arranged to engage a bowstring;

a tip comprising an intake inlet in fluid communication with the cavity, the tip comprising a first portion moveable with respect to a second portion between a first orientation and a second orientation; and an exhaust outlet in fluid communication with the cavity.

2. The arrow of claim 1, the nock comprising the exhaust outlet.

3. The arrow of claim 1, the shaft comprising the exhaust outlet.

4. The arrow of claim 3, the shaft comprising a plurality of exhaust outlets in fluid communication with the cavity.

5. The arrow of claim 4, the plurality of exhaust outlets comprising a ring of exhaust outlets, the ring oriented orthogonal to a central axis of the shaft.

6. The arrow of claim 5, comprising a plurality of rings of exhaust outlets, the rings spaced along a length of the shaft.

7. The arrow of claim 1, the nock comprising a fluid flowpath, the nock comprising a deflector oriented in the fluid flowpath.

8. The arrow of claim 7, wherein the arrow does not comprise vanes.

9. The arrow of claim 1, the tip comprising a biasing member arranged to bias the tip to the first orientation.

10. The arrow of claim 9, the biasing member comprising a magnet.

11. The arrow of claim 1, wherein the intake is open in the first orientation and closed in the second orientation.

12. An arrow comprising:

a shaft comprising a tubular wall comprising a cavity, the tubular wall comprising a plurality of apertures in fluid communication with the cavity;

a tip comprising a first vent and a second vent in fluid communication with the cavity, the first vent comprising the same length as the second vent; and a nock comprising a notch arranged to engage a bowstring.

13. The arrow of claim 12, the plurality of apertures arranged in a repeating pattern.

14. The arrow of claim 12, the plurality of apertures comprising a ring of apertures oriented orthogonal to a central longitudinal axis.

15. The arrow of claim 14, the plurality of apertures comprising a plurality of rings of apertures.

16. The arrow of claim 12, the nock comprising a nock cavity in fluid communication with the cavity of the shaft.

17. The arrow of claim 12, the first vent comprising a Naca duct.

18. The arrow of claim 12, the first vent and the second vent comprising similar shapes arranged at different orientations.

19. The arrow of claim 12, the first vent extending parallel to a central axis of the shaft.

20. The arrow of claim 19, the second vent extending parallel to a central axis of the shaft.

* * * * *